US009322342B2

(12) United States Patent
Dudar et al.

(10) Patent No.: US 9,322,342 B2
(45) Date of Patent: Apr. 26, 2016

(54) HYBRID VEHICLE FUEL SYSTEM LEAK DETECTION

(71) Applicant: Ford Global Technologies, LLC, Dearborn, MI (US)

(72) Inventors: Aed M. Dudar, Canton, MI (US); Mark W. Peters, Wolverine Lake, MI (US); Dennis Seung-Man Yang, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 177 days.

(21) Appl. No.: 13/864,938

(22) Filed: Apr. 17, 2013

(65) Prior Publication Data

US 2014/0316638 A1 Oct. 23, 2014

(51) Int. Cl.

| | |
|---|---|
| ***G07C 5/00*** | (2006.01) |
| ***F02D 29/02*** | (2006.01) |
| ***F02M 25/08*** | (2006.01) |

(52) U.S. Cl.

CPC ..... *F02D 29/02* (2013.01); *F02M 25/0809* (2013.01)

(58) Field of Classification Search

CPC ..... F02M 25/08; F02M 25/0809; F02D 29/02
See application file for complete search history.

(56) References Cited

U.S. PATENT DOCUMENTS

| | | | | | |
|---|---|---|---|---|---|
| 5,125,385 | A * | 6/1992 | Frinzel | F02M 25/0809 | 123/520 |
| 5,390,645 | A * | 2/1995 | Cook et al. | 123/520 | |
| 5,483,942 | A * | 1/1996 | Perry et al. | 123/520 | |
| 5,495,749 | A * | 3/1996 | Dawson et al. | 73/49.7 | |
| 5,819,196 | A * | 10/1998 | Holmes | F02D 41/2464 | 701/103 |
| 5,868,120 | A | 2/1999 | Van Wetten et al. | | |
| 6,089,081 | A * | 7/2000 | Cook | F02M 25/0809 | 73/114.39 |
| 6,164,123 | A * | 12/2000 | Corkill | F02M 25/0809 | 123/518 |
| 6,626,157 | B2 * | 9/2003 | Perry | 123/516 | |
| 7,077,112 | B2 * | 7/2006 | Mitani et al. | 123/518 | |
| 7,207,209 | B2 * | 4/2007 | Mitani et al. | 73/49.7 | |
| 7,313,487 | B2 * | 12/2007 | Yoshioka et al. | 702/51 | |
| 7,810,475 | B2 * | 10/2010 | Peters et al. | 123/519 | |
| 7,908,099 | B2 | 3/2011 | Behar et al. | | |
| 8,074,627 | B2 | 12/2011 | Siddiqui | | |

(Continued)

*Primary Examiner* — Mussa A Shaawat
(74) *Attorney, Agent, or Firm* — James Dottavio; Alleman Hall McCoy Russell & Tuttle LLP

(57) ABSTRACT

Methods and systems for fuel system leak detection in a hybrid electric vehicle using a fuel reservoir are disclosed. In one example approach, a method comprises, during an engine off condition, delivering fuel from a fuel tank into a reservoir while the fuel tank is vented to atmosphere, discontinuing delivering fuel into the reservoir, sealing the fuel tank from atmosphere, and following the sealing, indicating a leak based on a pressure increase in the fuel tank from a pressure when sealed from venting.

20 Claims, 4 Drawing Sheets

(56) References Cited

U.S. PATENT DOCUMENTS

2001/0022173 A1* 9/2001 Fabre ..... F02M 25/0809 123/519
2002/0046609 A1* 4/2002 Ito ..... F02M 25/0809 73/700
2003/0221675 A1* 12/2003 Washeleski ..... B60K 15/03504 123/497
2009/0204309 A1* 8/2009 Eser ..... F02M 25/0809 701/102
2010/0288021 A1* 11/2010 Makino et al. ..... 73/40.7
2011/0139130 A1* 6/2011 Siddiqui ..... 123/520
2011/0166765 A1* 7/2011 DeBastos et al. ..... 701/102
2011/0168138 A1* 7/2011 Achor ..... F02M 37/20 123/516
2012/0152210 A1 6/2012 Reddy et al.
2013/0098143 A1* 4/2013 Takagi ..... F02M 25/0818 73/40.5 R
2014/0069394 A1* 3/2014 Jentz ..... F02M 25/0809 123/520
2014/0257721 A1* 9/2014 Thompson et al. ..... 702/51
2014/0297071 A1* 10/2014 Dudar et al. ..... 701/22
2014/0330482 A1* 11/2014 Yang ..... G07C 5/00 701/34.4

* cited by examiner

HYBRID VEHICLE FUEL SYSTEM LEAK DETECTION

BACKGROUND/SUMMARY

A vehicle with an engine may include an evaporative emission control system coupled to a fuel system in order to reduce fuel vapor emissions. For example, an evaporative emission control system may include a fuel vapor canister coupled to a fuel tank which includes a fuel vapor adsorbent for capturing fuel vapors from the fuel tank while providing ventilation of the fuel tank to the atmosphere.

Leak testing may be periodically performed on such evaporative emission control systems in order to identify leaks in the system so that maintenance may be performed and mitigating actions may be taken in order to reduce emissions. In some examples, natural vacuum approaches may be used to perform leak detection in evaporative emissions systems in vehicles, e.g., in hybrid electric vehicles.

However, the inventors herein have recognized that due to limited engine run time in hybrid electric vehicles, sufficient natural vacuum may not be available for leak testing while the engine is running. Further, engine-off natural vacuum (EONV) leak detection approaches use a passive system which is dependent on driver behavior and powertrain type. Further, in such an approach, too little or too much heat rejection may skew the results of leak test. Further, in plug-in hybrid vehicle applications, the engine may or may not combust to generate sufficient heat so that EONV approaches may not be viable.

Active leak testing systems, which use powered pumps to provide vacuum to the fuel system for leak testing, may consume a significant amount of power in order to provide sufficient vacuum to perform leak tests. For example, this power consumption may reduce the time the test can execute during engine off conditions, e.g., after a key off event. Further, this energy draw may reduce how long the evaporative test can execute during engine off conditions in applications where battery power is limited, e.g., in hybrid electric applications.

Further, the inventors herein have recognized that it may be advantageous to perform leak test using pressure increases instead of or in addition to leak testing which uses vacuum increases in the fuel system. For example, seals in the fuel system may behave differently under pressure versus vacuum and thus it may be desirable to employ both a vacuum based and a pressure based phase to identify leaks in a fuel system with greater accuracy.

In one example approach, in order to at least partially address these issues, a method for a vehicle with an engine comprises, during an engine off condition delivering fuel from a fuel tank into a reservoir while the fuel tank is vented to atmosphere, and sealing the fuel tank from atmosphere and indicating a leak based on pressure in the fuel tank. The method may further comprise, during an engine off condition, delivering fuel from the fuel tank into the reservoir for a duration while the fuel tank is sealed from atmosphere, and indicating a leak based on vacuum in the fuel tank.

In this way, an active leak testing approach may be used in a hybrid vehicle application with limited engine run time while reducing an amount of time a pump is used thus reducing power consumption costs associated with the pump. For example, by using a fuel reservoir to assist in pressure and vacuum generation for leak testing in a hybrid vehicle, an amount of time the pump is operated to generate sufficient vacuum or pressure in the fuel system for leak testing may be reduced.

Further, in such an approach, pressure increases in the fuel system may be used to assist in diagnosing fuel system leaks rather than only relying on vacuum generated in the fuel system for leak testing. For example, by basing leak diagnostics on both pressure increases and vacuum increases in a fuel system, robustness and accuracy of leak diagnostics of a fuel system may be increased.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
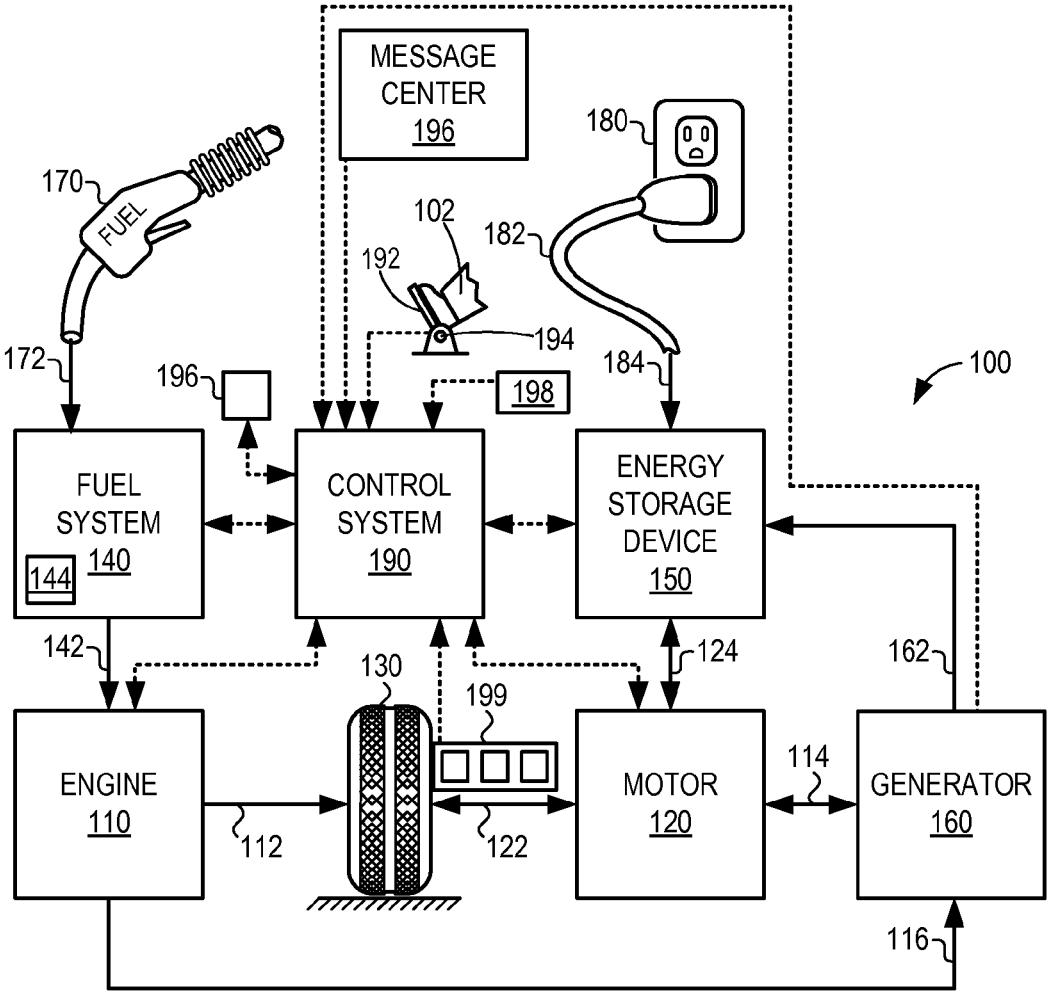
FIG. 1 shows an example vehicle propulsion system.
Figure 2:
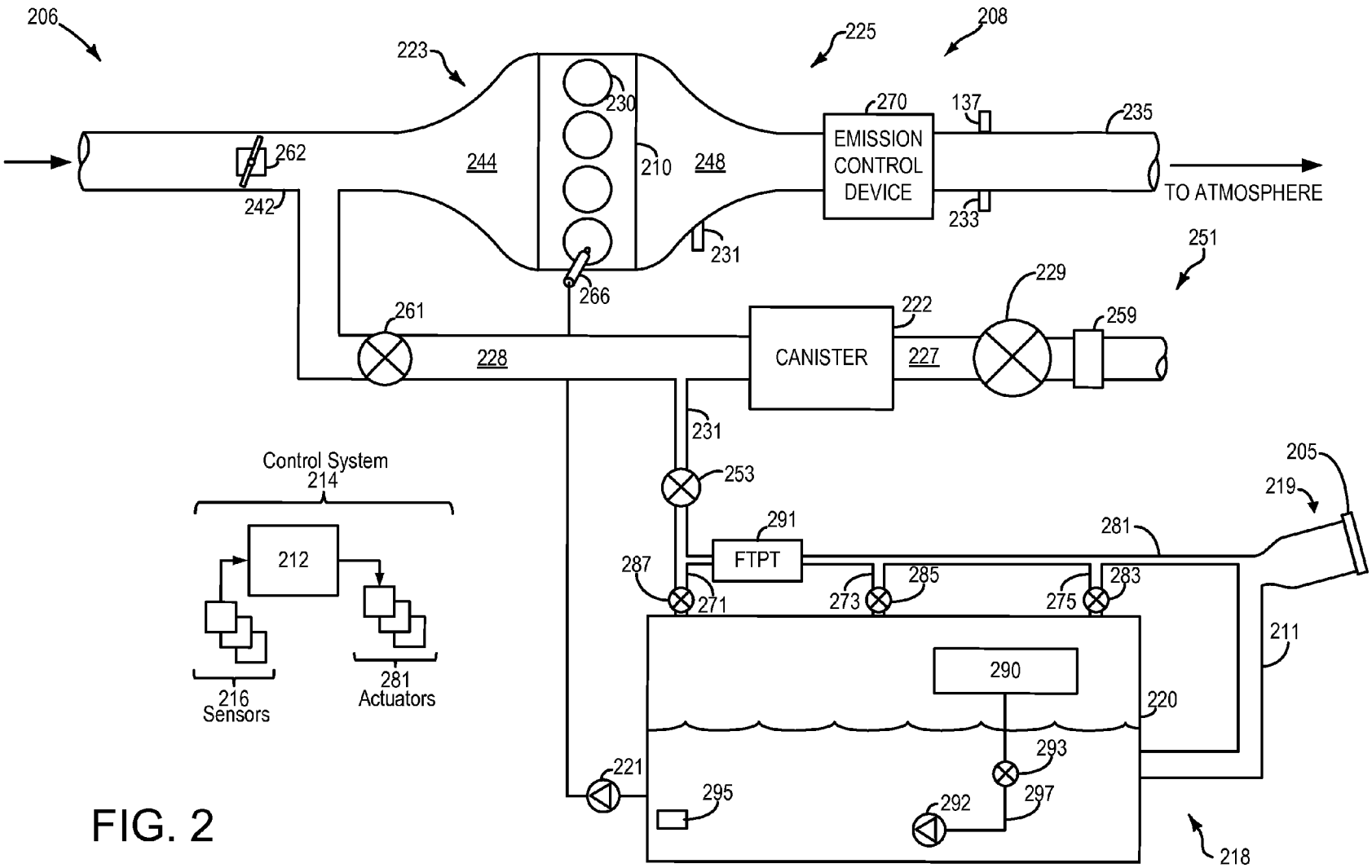
FIG. 2 shows an example vehicle system with a fuel emission control system.
Figure 3:
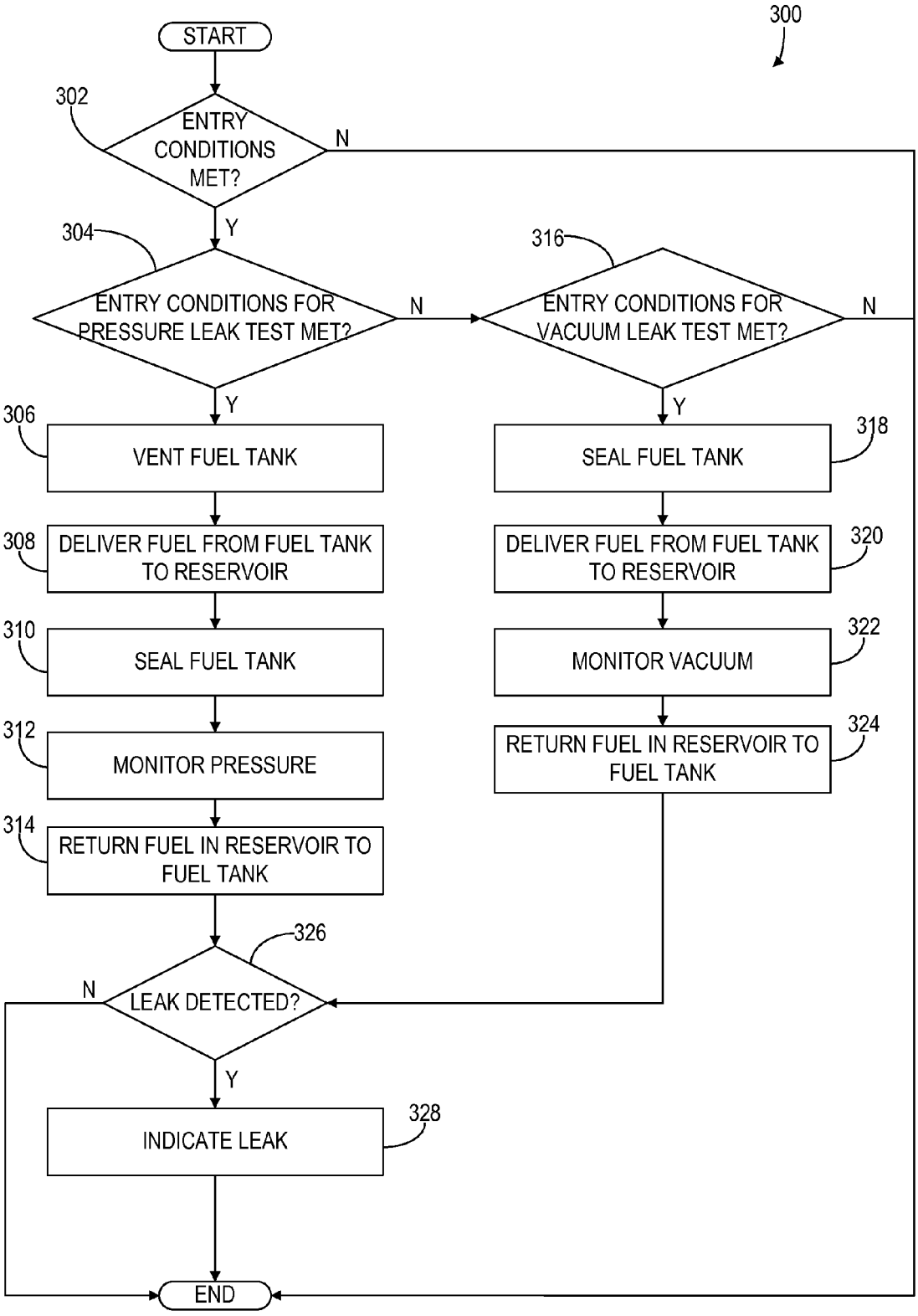
FIG. 3 shows an example method for operating a vehicle with an engine in accordance with the disclosure.
Figure 4:
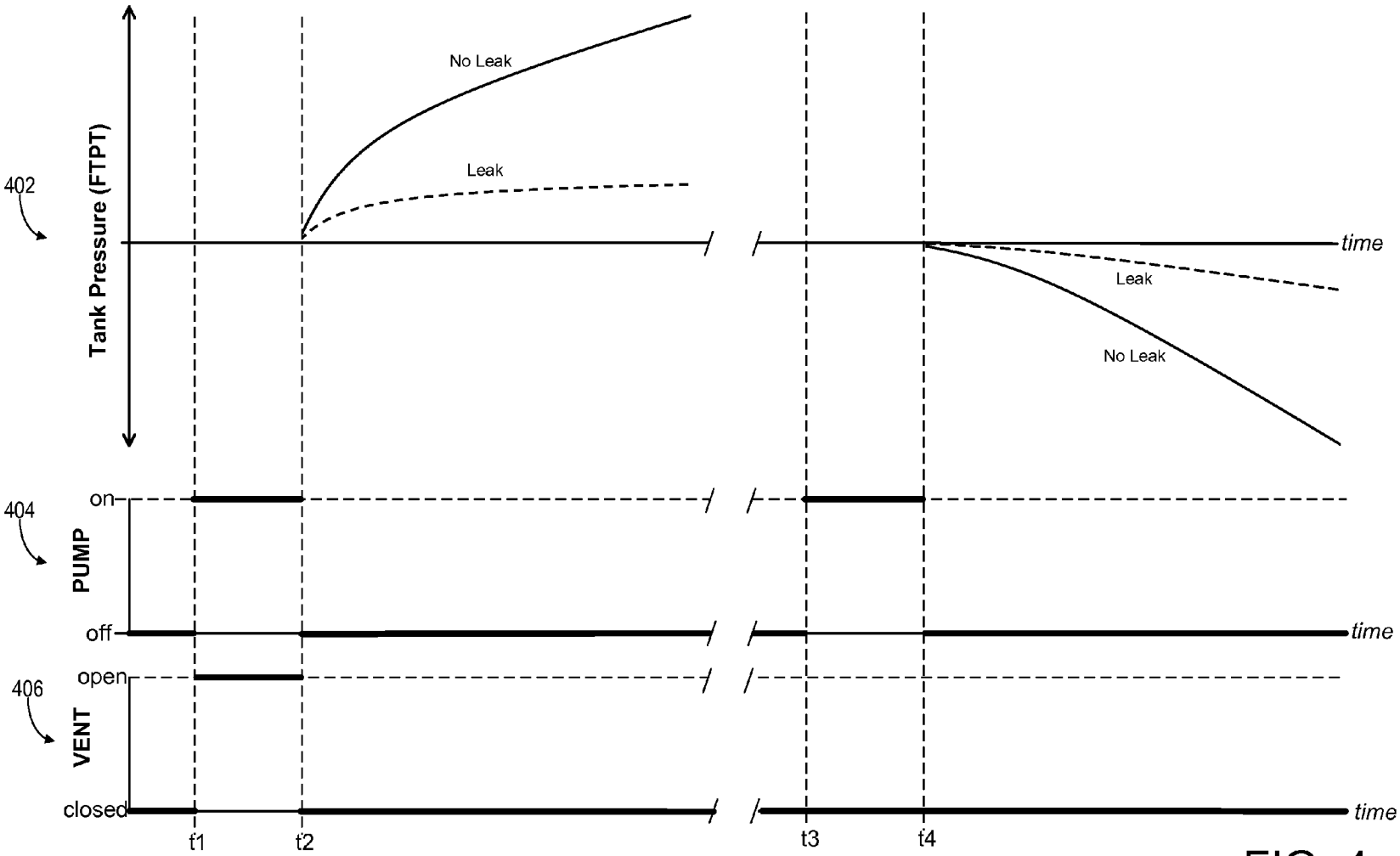
FIG. 4 illustrates leak testing using generated pressure and generated vacuum in a fuel system in accordance with the disclosure.

The following description relates to systems and methods for generating engine off vacuum and/or pressure in a fuel system via a fuel reservoir for leak diagnostics in a fuel system of a vehicle, such as the example vehicles shown in FIGS. 1 and 2. The reservoir may be sealed from the fuel tank such that it is maintained at a different pressure than the fuel tank, such as during leak testing as described herein. As shown in FIG. 3, a fuel pump may be operated to deliver fuel from a fuel tank to a fuel reservoir while the fuel system is vented to the atmosphere so that after fuel is delivered to the fuel reservoir and the fuel system is sealed from the atmosphere (and while the tank is sealed with respect to the reservoir, and vice versa), a pressure increase may be observed in the fuel tank to diagnose leaks. Additionally, in some examples as also shown in FIG. 3, the fuel pump may be operated to deliver fuel from the fuel tank to the fuel reservoir while the fuel system is sealed from the atmosphere (and while the tank is sealed with respect to the reservoir, and vice versa) in order to generate vacuum in the fuel tank for leak diagnostics. For example, as shown in FIG. 4, both pressure-based and vacuum-based leak testing may be performed at different times while the engine is off in order to more efficiently diagnose leaks in the fuel system. In on example, the reservoir may be positioned wholly within the fuel tank.

Turning now to the figures, FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g. gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (i.e. set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some embodiments. However, in other embodiments, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels.

In other embodiments, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g. E10, E85, etc.) or a blend of gasoline and methanol (e.g. M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. As will be described by the process flow of FIG. 3, control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal.

Energy storage device 150 may periodically receive electrical energy from a power source 180 residing external to the vehicle (e.g. not part of the vehicle) as indicated by arrow 184. As a non-limiting example, vehicle propulsion system 100 may be configured as a plug-in hybrid electric vehicle (HEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may disconnected between power source 180 and energy storage device 150. Control system 190 may identify and/or control the amount of electrical energy stored at the energy storage device, which may be referred to as the state of charge (SOC).

In other embodiments, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some embodiments, fuel tank 144 may be configured to store the fuel received from fuel dispensing device 170 until it is supplied to engine 110 for combustion. In some embodiments, control system 190 may receive an indication of the level of fuel stored at fuel tank 144 via a fuel level sensor. The level of fuel stored at fuel tank 144 (e.g. as identified by the fuel level sensor) may be communicated to the vehicle operator, for example, via a fuel gauge or indication lamp indicated at 196.

The vehicle propulsion system 100 may also include a message center 196, ambient temperature/humidity sensor 198, and a roll stability control sensor, such as a lateral and/or longitudinal and/or yaw rate sensor(s) 199. The message center may include indicator light(s) and/or a text-based display in which messages are displayed to an operator. The message center may also include various input portions for receiving an operator input, such as buttons, touch screens, voice input/recognition, etc. In an alternative embodiment, the message center may communicate audio messages to the operator without display. Further, the sensor(s) 199 may include a vertical accelerometer to indicate road roughness. These devices may be connected to control system 190. In one example, the control system may adjust engine output and/or the wheel brakes to increase vehicle stability in response to sensor(s) 199.

FIG. 2 shows a schematic depiction of a vehicle system 206. The vehicle system 206 includes an engine system 208 coupled to an emissions control system 251 and a fuel system 218. Emission control system 251 includes a fuel vapor canister 222 which may be used to capture and store fuel vapors. In some examples, vehicle system 206 may be a hybrid electric vehicle system.

The engine system 208 may include an engine 210 having a plurality of cylinders 230. The engine 210 includes an engine intake 223 and an engine exhaust 225. The engine intake 223 includes a throttle 262 fluidly coupled to the engine intake manifold 244 via an intake passage 242. The engine exhaust 225 includes an exhaust manifold 248 leading to an exhaust passage 235 that routes exhaust gas to the atmosphere. The engine exhaust 225 may include one or more emission control devices 270, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors.

Fuel system 218 may include a fuel tank 220 coupled to a fuel pump system 221. The fuel pump system 221 may include one or more pumps for pressurizing fuel delivered to the injectors of engine 210, such as the example injector 266 shown. While only a single injector 266 is shown, additional injectors are provided for each cylinder. It will be appreciated that fuel system 218 may be a return-less fuel system, a return fuel system, or various other types of fuel system.

Vapors generated in fuel system 218 may be routed to an evaporative emissions control system 251 which includes a fuel vapor canister 222 via vapor recovery line 231, before being purged to the engine intake 223. Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, and 275. Further, in some examples, one or more fuel tank isolation valves may be included in recovery line 231 or in conduits 271, 273, or 275. Among other functions, fuel tank isolation valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283, and/or conduit 231 may include an isolation valve 253. Further, in some examples, recovery line 231 may be coupled to a fuel filler system 219. In some examples, fuel filler system may include a fuel cap 205 for sealing off the fuel filler system from the atmosphere. However, in other examples, fuel filler system 219 may be a capless fuel filler system. Refueling system 219 is coupled to fuel tank 220 via a fuel filler pipe or neck 211.

A fuel tank pressure transducer (FTPT) 291, or fuel tank pressure sensor, may be included between the fuel tank 220 and fuel vapor canister 222, to provide an estimate of a fuel tank pressure. As described below, in some examples, during engine off conditions sensor 291 may be used to monitor changes in pressure and/or vacuum in the fuel system to determine if a leak is present. The fuel tank pressure transducer may alternately be located in vapor recovery line 231, purge line 228, vent line 227, or other location within emission control system 251 without affecting its engine-off leak detection ability.

Emissions control system 251 may include one or more emissions control devices, such as one or more fuel vapor canisters 222 filled with an appropriate adsorbent, the canisters are configured to temporarily trap fuel vapors (including vaporized hydrocarbons) during fuel tank refilling operations and "running loss" (that is, fuel vaporized during vehicle operation). In one example, the adsorbent used is activated charcoal. Emissions control system 251 may further include a canister ventilation path or vent line 227 which may route gases out of the canister 222 to the atmosphere when storing, or trapping, fuel vapors from fuel system 218.

Vent line 227 may also allow fresh air to be drawn into canister 222 when purging stored fuel vapors from fuel system 218 to engine intake 223 via purge line 228 and purge valve 261. For example, purge valve 261 may be normally closed but may be opened during certain conditions so that vacuum from engine intake 244 is provided to the fuel vapor canister for purging. In some examples, vent line 227 may include an air filter 259 disposed therein upstream of a canister 222.

Flow of air and vapors between canister 222 and the atmosphere may be regulated by a canister vent valve 229. Canister vent valve may be a normally open valve so that fuel tank isolation valve 253 may be used to control venting of fuel tank 220 with the atmosphere. For example, in hybrid vehicle applications, isolation valve 253 may be a normally closed valve so that by opening isolation valve 253, fuel tank 220 may be vented to the atmosphere and by closing isolation valve 253, fuel tank 220 may be sealed from the atmosphere. In some examples, isolation valve 253 may be actuated by a solenoid so that, in response to a current supplied to the solenoid, the valve will open. For example, in hybrid vehicle applications, the fuel tank 220 may be sealed off from the atmosphere in order to contain diurnal vapors inside the tank since the engine run time is not guaranteed. Thus, for example, isolation valve 253 may be a normally closed valve which is opened in response to certain conditions. For example, isolation valve 253 may be commanded open while the engine is off to perform leak testing as described below.

Fuel system 218 further includes a fuel reservoir 290 which is configured to receive fuel from fuel tank 220 during certain conditions. For example, fuel reservoir 290 may be fluidically coupled via conduit 296 to a pump 292 within fuel tank 220. In some examples, fuel reservoir 290 may be positioned inside or within an interior of fuel tank 220. However, in other examples, reservoir 290 may be positioned external to fuel tank 220. Fuel reservoir 290 may be any suitable storage device for fuel, e.g., fuel reservoir 290 may be a bladder, a small tank, or any other suitable fuel storage container.

In some examples, pump 292 may be the same pump used to deliver fuel to the engine, e.g., fuel pump 292 shown in FIG. 2 may indicate the same pump as pump 221. However, in other examples, pump 292 may be a separate pump from fuel pump 221. During certain conditions as described in more detail below, pump 292 may be operated for a duration to deliver an amount of fuel from fuel tank 220 to reservoir 290 for temporary storage therein.

For example, as described in more detail below, during an engine off condition, e.g., when the vehicle is operating using an auxiliary power source or when the vehicle is turned off, fuel tank 220 may be vented to the atmosphere and pump 292 operated for a short duration to deliver an amount of fuel from the fuel tank to the reservoir 290 while the fuel tank is vented. In this example, after the amount of fuel from the fuel tank is delivered to the reservoir 290, the fuel tank may then be sealed off from the atmosphere so that the decrease in volume of fuel within the tank causes a pressure build or pressure increase as a result of the partial pressure of fuels of the tank and the vapor dome trying to reach equilibrium. As described below, this pressure increase may be monitored to determine if leaks are present in the fuel system.

As another example, as described in more detail below, during an engine off condition, fuel tank 220 may be sealed off or may be maintained sealed off from the atmosphere while pump 292 is operated for a short duration to deliver an amount of fuel from the fuel tank to the reservoir 290 while the fuel tank is not in communication with the atmosphere. This decrease in volume of fuel in the tank while the fuel tank is sealed off from the atmosphere causes a vacuum to form within the fuel tank since pressure in the fuel tank decreases as the fuel volume decreases. As described below, this vacuum increase (pressure decrease) may also be monitored to determine if leaks are present in the fuel system.

Further, in some examples, conduit 297 may include an evacuation valve 293 disposed therein which may be configured to open while fuel is being delivered to reservoir 290 and may be configured to close after an amount of fuel is pumped into reservoir 290 in order to keep the amount of fuel within the reservoir so that the decrease in volume of fuel in the fuel tank generates pressure increases or vacuum increases for leak testing. After the leak test has been performed, evacuation valve 293 may be opened in order to return the fuel stored in the reservoir back into the fuel tank.

The vehicle system 206 may further include a control system 214. Control system 214 is shown receiving information from a plurality of sensors 216 (various examples of which are described herein) and sending control signals to a plurality of actuators 281 (various examples of which are described herein). As one example, sensors 216 may include exhaust gas sensor 237 located upstream of the emission control device, temperature sensor 233, pressure sensor 237, and pressure sensor 291. Other sensors such as pressure, temperature, air/fuel ratio, and composition sensors may be coupled to various locations in the vehicle system 206. As another example, the actuators may include fuel injector 266, throttle 262, fuel tank isolation valve 253, and pump 292. The control system 214 may include a controller 212. The controller may receive input data from the various sensors, process the input data, and trigger the actuators in response to the processed input data based on instruction or code programmed therein corresponding to one or more routines. An example control routine is described herein with regard to FIG. 3.

FIG. 3 shows an example method 300 for performing leak testing in a fuel system of a vehicle by generating pressure or vacuum with the assistance of a fuel reservoir, e.g., reservoir 290 described above. For example, method 300 may be used to perform fuel system leak diagnostics in a hybrid electric vehicle which has reduced or unreliable engine run-time. As remarked above, in hybrid vehicles there may not be sufficient natural vacuum generated to perform leak tests. Further, it may be desirable to perform leak diagnostics using both pressure increases and vacuum increases in the fuel system in order to more effectively diagnose leaks. The reservoir used in the leak tests described herein may reduce an amount of time a fuel pump is run to generate sufficient vacuum or pressure in the fuel system for leak testing. This reduction in fuel pump usage may reduce power consumption during leak testing while a vehicle is in an engine off mode.

At 302, method 300 includes determining if entry conditions are met. Entry conditions may include engine off conditions when an engine of the vehicle is not in operation. For example, the vehicle may be a hybrid electric vehicle operating in an engine off mode and being powered by batteries in the vehicle. As another example, entry conditions may include a key-off event wherein the vehicle is turned off, e.g., where the vehicle is parked or is not in use and the engine is not running. Entry conditions may be further based on temperatures in the fuel system or evaporative emission control system, e.g., entry conditions during engine-off conditions may be based on a temperature in the fuel system less than a threshold temperature or greater than a threshold temperature. For example, entry conditions may include determining if a temperature in the fuel system is in a predetermined range of temperatures. For example, if the temperatures are below a lower temperature threshold or above an upper temperature threshold then method 300 may end.

If entry conditions are met at 302, method 300 proceeds to 304. At 304, method 300 includes determining if entry conditions for a pressure leak test are met. For example, method 300 may determine if a first engine off condition is present wherein a leak test based on a pressure increase in the fuel tank is scheduled to be performed. Entry conditions for a pressure leak test may be based on a temperature in the fuel system, e.g., entry conditions may include a temperature above a threshold temperature. As another example, entry conditions for a pressure leak test may be based on whether or not a leak test based on a vacuum increase has occurred. For example, as described above, in some examples, it may be desirable to perform leak diagnostics on a fuel system based on both a pressure increase test and a vacuum increase test. Thus, in some examples, a pressure leak test may be scheduled to follow a vacuum leak test in order to effectively diagnose leaks. As another example, entry conditions for a pressure leak test may be based on a time duration greater than a threshold time duration since a previous leak test was performed.

If entry conditions for a pressure leak test are met at 304, method 300 proceeds to 306. At 306, method 300 includes venting the fuel tank. For example, fuel tank isolation valve 253 may be a normally closed valve and venting the fuel tank may include opening isolation valve 253 in order to vent the fuel tank to the atmosphere. Further, in some examples, venting the fuel tank to the atmosphere may additionally include opening or maintaining open canister vent valve 229 so that fuel tank 220 is put in communication with the atmosphere.

At 308, method 300 includes delivering fuel from the fuel tank to a fuel reservoir. In particular, during an engine off condition while the fuel tank is vented to the atmosphere, an amount of fuel may be delivered to the fuel reservoir. For example, pump 292 may be operated for a duration to deliver the amount of fuel into fuel reservoir 290 for temporary storage therein. In some examples, the amount of fuel delivered to reservoir 290 may be based on a size or volume of the reservoir and/or may be a pre-determined amount of fuel. As another example, the fuel pump may be operated for a predetermined duration in order to deliver a pre-determined amount of fuel to the reservoir. As still another example, the amount of fuel delivered from the fuel tank to the reservoir may be based on a desired pressure increase in the system. For example, an increased amount of fuel delivered to the reservoir may cause an increased amount of expected pressure increase in the fuel tank for leak testing.

At 310, method 300 includes sealing the fuel tank. For example, after the amount of fuel is delivered from the fuel tank to the reservoir while the fuel tank is vented to the atmosphere, the fuel tank may be sealed off from the atmosphere, e.g., by closing isolation valve 253 and/or by closing vent valve 229. Due to the decreased volume in the fuel tank, a pressure increase may occur within the fuel tank while the fuel tank is sealed from the atmosphere. This pressure increase may be monitored, e.g., via FTPT sensor 291, to determine if a leak is detected in the fuel system.

Thus, after the fuel tank is sealed from the atmosphere, at 312, method 300 includes monitoring pressure. For example, the pressure increase may be monitored via FTPT sensor 291 and compared with an expected pressure increase for a duration following sealing off the fuel tank from the atmosphere. For example, a leak may be indicated in response to the pressure increase less than a pressure increase threshold associated with an expected pressure increase in the system. For example, the expected pressure increase may be an expected tank pressure change corresponding the temperature in the fuel tank and may be a predetermined expected pressure increase. As another example, a suitable model, such as the ideal gas law (PV=nRT) may be used to approximate an expected pressure change for the fuel tank. By comparing the measured pressure increase to the expected pressure increase it may be determined whether or not a leak is present.

At 314, method 300 includes returning fuel in the reservoir to the fuel tank. For example, after the pressure leak test has been performed, e.g., after the pressure increase has been monitored for a duration to determine whether or not a leak is present in the fuel system, the fuel delivered and stored within the reservoir may be returned to the fuel tank. For example, evacuation valve 293 may be opened in order to permit fuel stored in the reservoir to return to the fuel tank 220.

Returning to 304, if entry conditions for a pressure leak test are not met at 304, then method 300 proceeds to 316. At 316, method 300 includes determining if entry conditions for a vacuum leak test are met. For example, method 300 may determine if a second engine off condition is present wherein a leak test based on a vacuum increase in the fuel tank is scheduled to be performed. Entry conditions for a vacuum leak test may be based on a temperature in the fuel system, e.g., entry conditions may include a temperature above a threshold temperature. As another example, entry conditions for a vacuum leak test may be based on whether or not a leak test based on a pressure increase has occurred. For example, as described above, in some examples, it may be desirable to perform leak diagnostics on a fuel system based on both a pressure increase test and a vacuum increase test. Thus, in some examples, a vacuum leak test may be scheduled to follow a pressure leak test, e.g., the pressure leak test described above with regard to steps 306-314, in order to effectively diagnose leaks. As another example, entry conditions for a vacuum leak test may be based on a time duration greater than a threshold duration since a previous leak test was performed.

If entry conditions for a vacuum leak test are met at 316, then method 300 proceeds to 318. At 318, method 300 includes sealing the fuel tank. In some examples, e.g., in hybrid vehicle applications, the fuel tank may be maintained sealed during vehicle operation, e.g., via maintaining fuel tank isolation valve 253 in a closed position. Thus, sealing the fuel tank may include maintaining the fuel tank sealed off from the atmosphere by maintaining isolation valve 253 closed or by closing vent valve 229. However, in some examples, during certain conditions, the fuel tank may be vented to the atmosphere, e.g., during a refueling event. In this example, sealing the fuel tank may include closing the isolation valve 253 and/or closing the vent valve 229 so that the fuel tank is not in communication with the atmosphere.

At 320, method 300 includes delivering fuel from the fuel tank to the reservoir. In particular, during an engine off condition while the fuel tank is sealed off from the atmosphere, an amount of fuel may be delivered to the fuel reservoir. For example, pump 292 may be operated for a duration to deliver the amount of fuel into fuel reservoir 290 for temporary storage therein. In some examples, the amount of fuel delivered to reservoir 290 may be based on a size or volume of the reservoir and/or may be a pre-determined amount of fuel. As another example, the fuel pump may be operated for a pre-determined duration in order to deliver a pre-determined amount of fuel to the reservoir. As still another example, the amount of fuel delivered from the fuel tank to the reservoir may be based on a desired vacuum increase in the system. For example, an increased amount of fuel delivered to the reservoir while the fuel tank is sealed off from the atmosphere may cause an increased amount of expected vacuum increase (pressure decrease) in the fuel tank for leak testing.

At 322, method 300 includes monitoring vacuum. For example, the vacuum increase (pressure decrease) may be monitored via FTPT sensor 291 while the fuel tank remains sealed off from the atmosphere and compared with an expected vacuum increase for a duration following the delivery of the amount of fuel from the fuel tank to the reservoir. For example, a leak may be indicated in response to the vacuum increase less than a vacuum increase threshold associated with an expected vacuum increase in the system. For example, the expected vacuum increase may be an expected tank vacuum change corresponding the temperature in the fuel tank and may be a predetermined expected vacuum increase. As another example, a suitable model, such as the ideal gas law (PV=nRT) may be used to approximate an expected vacuum change for the fuel tank. By comparing the measured vacuum increase to the expected vacuum increase it may be determined whether or not a leak is present.

At 324, method 300 includes returning fuel in the reservoir to the fuel tank. For example, after the vacuum leak test has been performed, e.g., after the vacuum increase has been monitored for a duration to determine whether or not a leak is present in the fuel system, the fuel delivered and stored within the reservoir may be returned to the fuel tank. For example, evacuation valve 293 may be opened in order to permit fuel stored in the reservoir to return to the fuel tank 220.

After generating pressure for leak diagnostics in steps 306-314 and/or after generating vacuum for leak diagnostics in steps 318-324, method 300 proceeds to 326 to determine if a leak was detected. As remarked above, in some examples a leak may be reported only when a leak is detected during both a pressure-based leak test and a vacuum-based leak test. However, in other examples, a leak may be reported if a leak was detected during one or both of a pressure-based leak test and a vacuum-based leak test.

If a leak was detected at 326, method 300 proceeds to 328 to indicate a leak. For example, a degradation of the fuel system may be indicated so that mitigating actions may be performed. For example, a diagnostic code may be set in an onboard diagnostics system in the vehicle and/or a message may be sent to a message center in the vehicle to alert a vehicle operator of the degradation in the fuel system.

FIG. 4 illustrates leak testing using generated pressure and generated vacuum in a fuel system, where the generation of pressure and vacuum in the fuel tank is assisted by a fuel reservoir, e.g., reservoir 290. At 402, FIG. 4 shows an example graph of fuel tank pressure, e.g., as measure by FTPT sensor 291, versus time. At 404, FIG. 4 shows an example graph of a fuel pump operation used to deliver an amount of fuel from the fuel tank to the reservoir in order to generate pressure or vacuum in the fuel tank. For example, the graph at 404 indicates whether fuel pump 292 is in operation (on) or is not in operation (off). At 406, FIG. 4 shows a graph of fuel tank venting to the atmosphere. For example, the graph at 406 may indicate whether fuel tank isolation valve 253 is open so that the fuel tank is vented to the atmosphere, or closed so that the fuel tank is not vented to the atmosphere.

Before time t1 in FIG. 4, the fuel pump 292 is off and the fuel tank is isolated from the atmosphere. For example, the engine may not be in operation and the fuel tank may be maintained isolated from the atmosphere in order to contain diurnal vapors. At time t1, a first engine operating condition occurs where a pressure-based leak test is initiated. Thus, the fuel tank is vented, e.g., isolation valve 253 is opened, and the fuel pump 292 is turned on to deliver an amount of fuel from the fuel tank to the reservoir. At time t2, the fuel pump is turned off to discontinue delivery of fuel from the fuel tank to the reservoir and the fuel tank is again isolated from the atmosphere, e.g., by closing isolation valve 253. For a duration following time t2, pressure changes in the fuel tank are monitored. As shown in the graph at 402 after time t2 but before time t3, a leak may be indicated based on how much the pressure increases. For example, the curve labeled "No Leak" may correspond to an expected pressure increase when no leak is present in the fuel system. However, the curve labeled "Leak" provides an indication of a leak in the fuel system since the pressure increase in this curve is less than the expected pressure increase.

After the pressure increase is monitored for a duration sufficient to determine whether or not a leak is present, the fuel stored in the reservoir may be returned to the fuel tank, e.g., by opening evacuation valve 293. Following this pressure-based leak test, a vacuum-based leak test may then be performed. For example, at time t3 a second engine operating condition occurs where a vacuum-based leak test is initiated. In this example, the fuel tank is maintained isolated from the atmosphere between time t3 and time t4 while the fuel pump is operated to deliver an amount of fuel from the fuel tank to the reservoir. Operation of the fuel pump 292 is discontinued at time t4 and for a duration following time t4 pressure changes in the fuel tank are again monitored. In this example, vacuum is generated, i.e., a pressure decrease is generated, in the fuel tank due to the decrease in fuel volume in the fuel tank while the fuel tank is sealed off from the atmosphere. As shown in the graph at 402 after time t4, a leak may be indicated based on how much the pressure decreases. For example, the curve labeled "No Leak" may correspond to an expected pressure decrease when no leak is present in the fuel system. However, the curve labeled "Leak" provides an indication of a leak in the fuel system since the pressure decrease in this curve is less than the expected pressure decrease. After the pressure decrease is monitored for a duration sufficient to determine whether or not a leak is present, the fuel stored in the reservoir may be again returned to the fuel tank, e.g., by opening evacuation valve 293.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for a vehicle with an engine, comprising:
during an engine off condition,
delivering fuel from a fuel tank into a reservoir while the fuel tank is vented to atmosphere;
discontinuing delivering fuel into the reservoir;
sealing the fuel tank from atmosphere; and
following the sealing, indicating a leak based on a pressure increase in the fuel tank from a pressure when sealed from venting.

2. The method of claim 1, wherein delivering fuel from the fuel tank into the reservoir comprises operating a fuel pump for a duration while the fuel tank is vented to the atmosphere, and wherein the delivering fuel from the fuel tank into the reservoir occurs while the reservoir is sealed from the fuel tank such that the reservoir is at a different internal pressure than the fuel tank.

3. The method of claim 1, further comprising:
opening a fuel tank isolation valve to vent the fuel tank to the atmosphere while delivering fuel from the fuel tank into the reservoir; and
closing the fuel tank isolation valve and discontinuing delivery of fuel from the fuel tank into the reservoir after a duration to generate the pressure increase in the fuel tank for leak diagnostics.

4. The method of claim 1, wherein the reservoir is located inside of the fuel tank.

5. The method of claim 1, wherein the vehicle is a hybrid electric vehicle.

6. The method of claim 1, further comprising indicating the leak in response to the pressure increase being less than a pressure increase threshold while the fuel tank is sealed from atmosphere.

7. The method of claim 1, further comprising:
during the engine off condition, delivering fuel from the fuel tank into the reservoir for a duration while the fuel tank is sealed from atmosphere; and
indicating a leak based on a vacuum increase in the fuel tank.

8. The method of claim 7, further comprising:
closing a fuel tank isolation valve to seal the fuel tank from the atmosphere while delivering fuel from the fuel tank into the reservoir; and
discontinuing delivery of fuel from the fuel tank into the reservoir after the duration to generate the vacuum increase in the fuel tank for leak diagnostics.

9. The method of claim 7, further comprising indicating the leak in response to the vacuum increase being less than a vacuum increase threshold while the fuel tank is sealed from atmosphere.

10. A method for a vehicle with an engine with a fuel system, comprising:

during a first engine off condition, generating a pressure increase by delivering fuel from a fuel tank into a reservoir with the fuel tank vented to atmosphere and identifying leaks based on the pressure increase; and during a second engine off condition, generating vacuum by delivering fuel from the fuel tank into the reservoir with the fuel tank sealed from atmosphere and identifying leaks based on the generated vacuum.

11. The method of claim 10, further comprising:

during the first engine off condition operating a fuel pump to deliver fuel from the fuel tank into the reservoir while the fuel tank is vented to atmosphere and then sealing the fuel tank from atmosphere and identifying a leaks based on the pressure increase in the fuel tank; and during the second engine off condition operating the fuel pump to deliver fuel from the fuel tank into the reservoir while the fuel tank is sealed from the atmosphere and identifying leaks based on a pressure decrease in the fuel tank.

12. The method of claim 10, further comprising indicating a degradation in the fuel system of the vehicle in response to both identifying leaks based on the pressure increase in the fuel tank during the first engine off condition and identifying leaks based on the generated vacuum in the fuel tank during the second engine off condition.

13. The method of claim 10, further comprising:

during the first engine off condition opening a fuel tank isolation valve and operating a fuel pump to deliver fuel from the fuel tank into the reservoir and then closing the fuel tank isolation valve and discontinuing operation of the fuel pump and indicating leaks based on the pressure increase in the fuel tank being less than a pressure increase threshold after operation of the fuel pump is discontinued; and during the second engine off condition closing the fuel tank isolation valve and operating the fuel pump to deliver fuel from the fuel tank into the reservoir and then discontinuing operation of the fuel pump and indicating leaks based on a vacuum increase in the fuel tank less than a vacuum increase threshold after operation of the fuel pump is discontinued.

14. The method of claim 10, wherein the reservoir is located inside of the fuel tank.

15. The method of claim 10, wherein the vehicle is a hybrid electric vehicle.

16. The method of claim 10, wherein during the first engine off condition, a first amount of fuel is delivered from the fuel tank into the reservoir, the method further comprising returning the first amount of fuel to the fuel tank after generating the pressure increase for leak diagnostics, and wherein, during the second engine off condition, a second amount of fuel is delivered from the fuel tank into the reservoir, the method further comprising returning the second amount of fuel to the fuel tank after generating vacuum for leak diagnostics.

17. A vehicle system, comprising:

a fuel system including a fuel tank and a fuel vapor canister;

a fuel reservoir;

a fuel pump;

a fuel tank isolation valve; and a controller including non-transitory instructions to:

during a first engine off condition:

open the fuel tank isolation valve and operate the fuel pump to deliver fuel from the fuel tank into the reservoir;

close the fuel tank isolation valve and discontinue operation of the fuel pump; and indicate a leak based on a pressure increase in the fuel tank being less than a pressure increase threshold after operation of the fuel pump is discontinued; and during a second engine off condition:

close the fuel tank isolation valve and operate the fuel pump to deliver fuel from the fuel tank into the reservoir; and discontinue operation of the fuel pump and indicate a leak based on a vacuum increase in the fuel tank being less than a vacuum increase threshold after operation of the fuel pump is discontinued.

18. The system of claim 17, further comprising indicating a degradation in the fuel system of a vehicle only in response to both an indication of a leak based on pressure generated in the fuel tank during the first engine off condition and an indication of a leak based on vacuum generated in the fuel tank during the second engine off condition.

19. The system of claim 17, wherein the reservoir is located inside of the fuel tank.

20. The system of claim 17, wherein the vehicle system is a plug-in hybrid electric vehicle.

* * * * *